United States Patent [19]

Pfeifer et al.

[11] 4,290,827

[45] Sep. 22, 1981

[54] PROCESS FOR PRODUCING NI-FE MAGNETIC TAPE CORES

[75] Inventors: Friedrich Pfeifer, Bruchkoebel; Wernfried Behnke, Rodenbach, both of Fed. Rep. of Germany

[73] Assignee: Vacuumschmelze GmbH, Fed. Rep. of Germany

[21] Appl. No.: 27,154

[22] Filed: Apr. 4, 1979

[30] Foreign Application Priority Data

Apr. 5, 1978 [DE] Fed. Rep. of Germany ..... 2814640

[51] Int. Cl.[3] ..... C21D 1/04

[52] U.S. Cl. ..... 148/108; 148/31.55; 148/31.57; 148/103

[58] Field of Search ..... 148/31.55, 100, 108, 148/101, 103

[56] References Cited

U.S. PATENT DOCUMENTS

| | | | |
|---|---|---|---|
| 2,002,696 | 5/1935 | Kelsall | 148/31.55 |
| 2,430,464 | 11/1947 | Gould | 148/108 |
| 2,891,883 | 6/1959 | Howe | 148/31.55 |
| 3,125,472 | 3/1964 | Yamamoto et al. | 148/108 |
| 3,546,031 | 12/1970 | Pfeifer et al. | 148/108 |
| 3,556,876 | 1/1971 | Pfeifer et al. | 148/108 |

FOREIGN PATENT DOCUMENTS

| | | |
|---|---|---|
| 1558820 | 12/1971 | Fed. Rep. of Germany . |
| 1558818 | 10/1975 | Fed. Rep. of Germany . |
| 125713 | 5/1977 | German Democratic Rep. . |

OTHER PUBLICATIONS

Von Friedrich Pfeifer, *Zeitschrift für Metallkunde* (Journal for Metalography) vol. 57, (1966) pp. 240–244.

Von Kar Scheel, *Zeitshrift für Physich* (Journal for Physics) vol. 94 (1935) pp. 504–522.

Bozorth, *Ferromagnetism,* D. Van Nostrand Co. Inc., New York, 1951, pp. 117–134, 175 and 868–869.

*Magnetism and Metallurgy* vol. 2, Academic Press, New York, 1969, pp. 577–580.

*Primary Examiner*—L. Dewayne Rutledge

*Assistant Examiner*—John P. Sheehan

*Attorney, Agent, or Firm*—Hill, Van Santen, Steadman, Chiara & Simpson

[57] ABSTRACT

An alloy comprised of 45 to 53 wt. % Ni with the remainder iron, and including small amounts of deoxidizing and processing additives is worked into a 0.01 to 0.1 mm thick tape, wound to form a tape core and is then subjected to a final annealing for at least one hour at a temperature of at least 900° C. and thereafter is subjected to a tempering in a magnetic cross-field (i.e., the magnetic lines of force are applied in the plane of the tape perpendicular to the rolling direction thereof). The process provides high impulse permeabilities at induction rises of 1T or larger within the so-processed tape cores. Particularly high impulse permeabilities are achieved in instances where an anisotropic structure with a privileged grain direction <001> in the rolling direction is generated in the tape material via heating and final deformation before winding into a tape core and via a final annealing after winding of the tape core. The so-produced tape cores are useful in various electrical applications, particularly in pulse transformers and thyristor choke coils.

8 Claims, 7 Drawing Figures

PROCESS FOR PRODUCING NI-FE MAGNETIC TAPE CORES

BACKGROUND OF THE INVENTION

1. Field of the Invention

The invention relates to magnetic tape cores and somewhat more particularly to a process of producing Ni-Fe magnetic tape cores by annealing and magnetic tempering.

2. Prior Art

It is known to subject tape cores composed of Ni-Fe alloys having 48 to 67 wt. % Ni therein, to a final annealing for about 5 hours at a temperature ranging between 1150° to 1200° C. in pure hydrogen and thereafter to subject the so-annealed tape cores to tempering in a magnetic field which is applied in the plane of the tape parallel to the direction in which the tape material is rolled. By tempering in such a so-called longitudinal magnetic field, one obtains rectangularly-shaped hysteresis loops or, particularly, high dynamic permeabilities upon small modulations [see, for example, *Zeitschrift für Metallkunde* (Journal For Metalography), Vol. 57 (1966) pages 240–244].

However, tape cores treated in the above-described prior art process are not suitable for applications which require a large induction rise and a large impulse permeability, i.e., such as in choke coils having a constant pre-magnetization field or in pulse transformers which function in unipolar fashion. For such and similar applications or uses, heretofore available tape cores composed of Ni-Fe-Mo alloys having a relatively large nickel content of 61 to 67 wt. % or, respectively, 74 to 84 wt. % have been used. Such tape cores, after a final annealing for a number of hours at temperatures ranging between 950° to 1220° C. were subjected to a tempering in a magnetic field whose lines of force in the tape core were perpendicular to the direction of the magnetic flux in the cores during actual usage, i.e., perpendicular to the rolling direction of the cores. So-treated tape cores, which are characterized by very flat hysteresis loops, have relatively high impulse permeabilities which, as a function of induction rise, at first exhibit a substantially constant course but upon discharge into saturation, corresponding to induction rises between about 0.4 to 0.8T, quickly decrease to small values far below 4000 (for example, see German Letters Pat. Nos. 1,558,818 and 1,558,820, which respectively correspond to U.S. Pat. Nos. 3,546,031 and 3,556,876).

SUMMARY OF THE INVENTION

The invention provides tape cores which have relatively high impulse permeabilities sufficient for technical application with relatively high induction rises of 1T or more as well as a process of producing such tape cores.

In accordance with the principles of the invention, tape cores are produced from an alloy comprised of 45 to 53 wt. % Ni, with the remainder iron and including small amounts of deoxidizing and processing additives by working such alloy into a 0.01 to 0.1 mm thick tape, winding such tape into a tape core, subjecting such tape core to a final annealing at a temperature of at least 900° C. for at least about one hour and then subjecting the soannealed tape core to tempering in a magnetic cross-field so that the magnetic field is applied to the tape core in the plane of the tape perpendicular to the rolling direction of such tape.

By tempering tape cores composed of the above-described alloys comprised of 45 to 53 wt. % Ni, with the remainder iron, in a magnectic cross-field (which is known per se with the alloys referred to above having a relatively high nickel content), one surprisingly obtains impulse permeabilities which are at least about 4000 and even higher, with induction rises of 1T and more. This is unexpected because, starting from the initially-referenced prior art alloys having a relatively large amount of nickel therein, the exploitable induction rises and impulse permeabilities attained by magnetic cross-field tempering greatly decrease with decreasing amounts of nickel, with simultaneous increases in the magnetization losses. For example, tape cores formed from alloys having 56 wt. % Ni, with the remainder iron, would be totally unsuitable for use in, for example, electrical components with unipolar magnetization, even after a magnetic cross-field tempering. Further, since the Curie temperature of Ni-Fe alloys decreases with decreasing amount of Ni, alloys having a nickel content below 56 wt. % should exhibit an even poorer response to magnetic cross-field tempering.

Although it is known in another area to temper tapes or tape cores formed from Ni-Fe alloys having about 50 wt. % Ni therein, in a magnetic cross-field, in one case [*Zeitschrift für Physik* (J. for Physics), Vol. 94, (1935) pages 504–522] it concerns only acedemic experimentation on flat alloy strips and in another case (U.S. Pat. No. 3,125,472) it relates to torodial tape cores, which, in contrast to the cores produced in accordance with the principles of the invention, include an air gap extending across the core in a radial direction and which have permeabilities, in a frequency range up to 50 kHz, consistantly ranging from only about 1200 to 1500. However, the foregoing prior art fails to provide any useful suggestions relative to the suitablility of a magnetic cross-field tempering for tape cores which have high impulse permeabilities, given large induction rises.

The process of the invention provides technically useful impulse permeability values over the entire alloy range of 45 to 53 wt. % Ni, given an induction rise of around 1T. Particularly high impulse permeabilities and induction rises are achieved in a preferred alloy range of 47 to 52 wt. % Ni and event more so with a more preferred alloy range of 49 to 51 wt. % Ni. Of course, these alloys may contain relatively small amounts of conventional deoxidation and processing materials. For example, any of the foregoing alloys may contain about 0.2 to 1.0 wt. % of Mn, 0.05 to 0.3 wt. % of Si as well as other additives such as Mg, Ca, Ce, etc., in an amount less than about 0.5 wt. %.

After a final annealing, the tape material may have a fine-grained isotropic structure, which is created via heating and working or deformation of the alloy into a desired size tape before winding such tape into a core and then subjecting the so-wound core to the final annealing conditions. Accordingly, before the final deformation, the tape is heated to a temperature above a temperature limit (which rises with increasing degrees of final deformations) above which a structure is formed which, during the final annealing, give rise to the fine-grained isotropic structure. The nature of this temperature limit will be explained in further detailed herein above.

A particularly preferable means of creating a fine-grained isotropic structure comprises heating an alloy at a temperature of at least 700° C. for at least one hour and conducting a final deformation or reduction of the tape in an amount ranging from about 80 to 90% of its thickness before the final deformation or reduction. The heating may comprise an intermediate annealing between a cold working and the final deformation. However, the heating may also occur during hot deformation or rolling of a tape before the final deformation, i.e., before a cold rolling.

In the practice of the invention, a final annealing is preferable conducted at a temperature in the range of about 900° to 1250° C., with the upper temperature limit being essentially governed by the furnace system utilized.

Further, increases in impulse permeabilities, given high induction rises, can be achieved with an anisotropic structure having a <001> privileged direction generated in the rolling direction of the tape material by heating and final deformation, before winding such tape into a core and thereafter finally annealing the so-wound core. Such treatment of a tape causes a further privileged direction, which extends parallel to the tape rolling direction and thus in the direction of the later magnetic flux in the tape core, to be superimposed on the magnetic privilege direction generated via tempering in the magnetic cross-field. Such magnetic privileged direction is perpendicular to the rolling direction of the tape material and thus perpendicular to the magnetic flux in the tape core during actual usage.

The amount of crystallites aligned in a privileged direction preferably comprises at least about 20% of the total structure.

A structure having a privileged direction in the rolling direction thereof may comprise a cubic structure (100) <001>, wherein aligned crystallites within the polycrystalline material lie parallel to the rolling plane with their cube plane and lie parallel and perpendicular to the rolling direction with their cube edges. In addition, a secondary recrystallization structure is also attained which preferably contains magnetically favorable cyrstal grains in the (210) <001>-position. At this position, the (210) -plane lies parallel to the rolling plane and the <001>-direction lies parallel to the rolling direction.

In certain preferred embodiments of the invention, one attains a tape core with an anisotropic structure having a <001> privileged direction in the rolling direction of the tape material. Such tape cores are attained by ensuring that the final deformation amounts to at least 90% of the tape thickness before final deformation and that the tape is previously heated to a temperature above about 600° C. and below the earlier-mentioned temperature limit, which increases with the amount or degree of final deformation. Above such temperature limit, a structure is formed which provides a fine-grained isotropic structure on final annealing. Heating before the final deformation (via a cold rolling), may occur via an intermediate annealing after a preceding one or more cold deformation step, or the heat encountered during hot rolling before the final cold rolling may be utilized.

Structural textures which arise in tape materials depend on the temperature of the final annealing. In instances where a final annealing occurs in a temperature range of about 900° to 1050° C., a cubic texture (100) <001> is attained, while in instances where the final annealing occurs in a temperature range of about 1050° to 1200° C., a secondary recrystallization structure is attained. Further, if in the latter case an alloy is heated to a temperature above about 700° C. before the final deformation thereof into a tape, a secondary recrystallization structure containing preferred grains in (210) <001>-position is attained. In accordance with the principles of the invention, the final annealing preferably spans at least about one hour and more preferably at least about two hours.

In instances where a heating before the final deformation occurs as an intermediate annealing step, such heating preferably extends at least one hour and more preferably extends two to five hours, both for isotropic and anisotropic structures.

The tempering treatment in the magnetic cross-field, which causes an atomic super-structure with a privileged direction in the tape plane perpendicular to the rolling direction, is preferably conducted, after an earlier heating of the tape cores above the Curie temperature of the tape material, over a time span of at least 30 minutes and at a temperature in the range between about 300° C. and the Curie temperature. Generally, heating a tape material above the Curie temperature thereof, causes, above all, a cancellation of any tempering states which may, perhaps, have preceded such heating and can, under certain conditions be omitted if desired.

Specific embodiments of the magnetic tempering treatment may vary. For example, the tape material may be allowed to cool-off in a furnace means from the Curie temperature or a temperature above the Curie temperature at cooling rates of about 300° C. per hour and less, with the application of the magnetic cross-field occurring within the above-designated range. Once the so-cooled and tempered tape cores attain a temperature of about 200° C., further cooling may occur naturally, without monitoring of the cooling rate. As another example, the tape cores may first be cooled-off to a select tempering temperature (within a range of between about 300° C. and the Curie temperature) in the furnace means from a temperature, for example of about 550° C., at a cooling rate of about 200° C. per hour and then maintained at such tempering temperature (with the application of the magnetic cross-field) for a number of hours preferably about four hours, and finally cooled still further in the furnace means.

Particularly for alloys having a Ni content below 49 wt. %, for example, 47.5 wt. % Ni, which have relatively low Curie temperatures and thus relatively low tempering temperatures, it is preferable to first cool-off the tape cores without applications of a magnetic cross-field in the furnace means from about 550° C. to about 500° C., to temper such cores at this temperature for at least about 1 hour and thereafter "freeze-in" excess vacancies via a quick quench outside the furnance means. Thereafter, tempering in a magnetic cross-field is undertaken, for example, at a temperature of about 300° C. to 450° C. and spans, at least 30 minutes and, preferably, a number of hours. The magnetic field applied during the tempering process is preferably, of sufficient strength to approximately saturate the tape material whereby the inner field within the tape material is at least 5 A/cm.

BRIEF DESCRIPTION OF THE DRAWINGS

FIG. 2 illustrating this relation for a final annealing temperature range 1050° to 1200° C.;

DESCRIPTION OF THE PREFERRED EMBODIMENT

The invention provides Ni-Fe alloy magnetic tape cores characterized by relatively large impulse permeabilities and relatively high induction rises and a process of producing such cores.

In accordance with the principles of the invention, an alloy ingot composed of about 45 to 53 weight percent nickel, with the remainder iron and including relatively small amounts of deoxidizing and processing additives is worked or deformed into a 0.01 to 0.1 mm thick tape and wound into a tape core. Such tape core is then subjected to a final annealing at a temperature of at least about 900° C. for at least about 1 hour and is thereafter subjected to a magnetic tempering in a magnetic field applied in the plane of the tape and perpendicular to the direction in which the tape material has been rolled.

Figure 1:
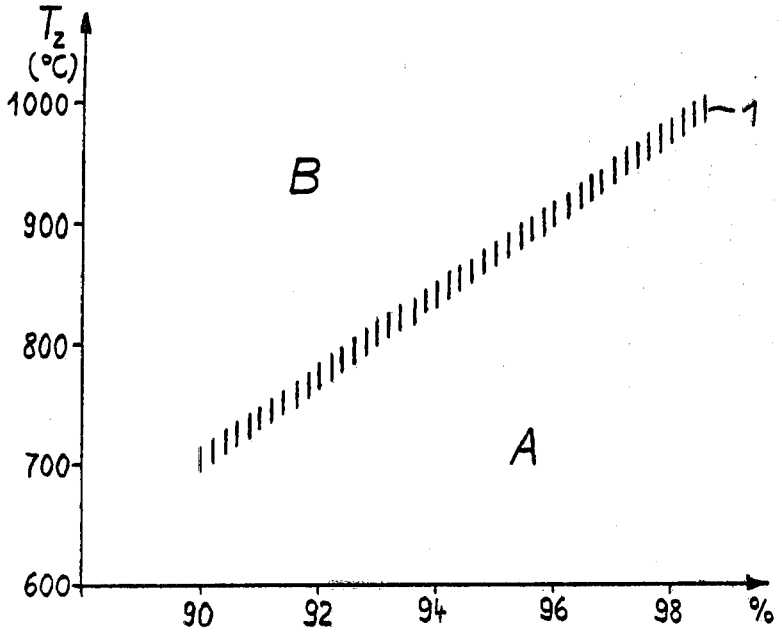
FIGS. 1 and 2 are graphical illustrations of the relation between a temperature limit for heating and/or intermediate annealing and the degree of final deformation of an alloy ingot in accordance with the principles of the invention, with FIG. 1 illustrating this relation for a final annealing temperature range of 900° to 1050° C.
Figure 2:
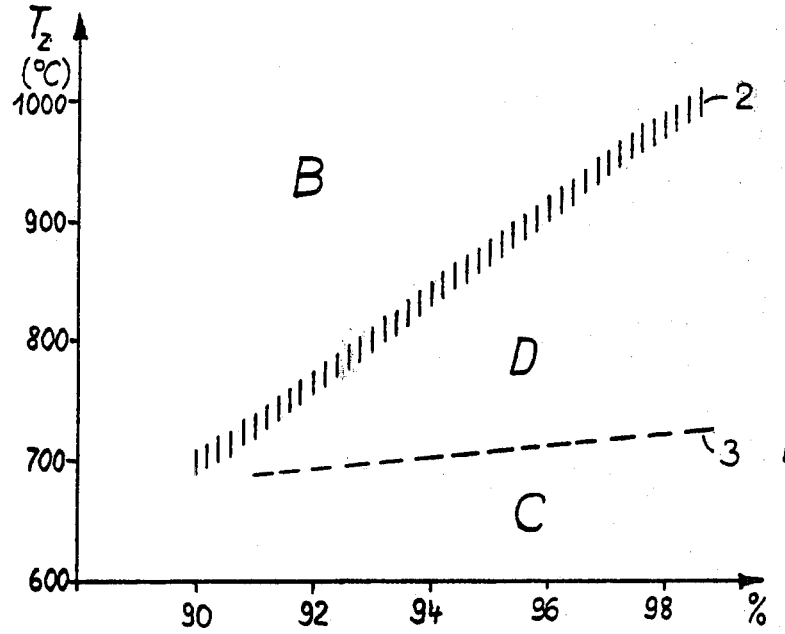

The formation of desired crystalline structures in accordance with the principles of the invention within tape cores is best explained in conjunction with FIGS. 1 and 2. In the graphs illustrated at FIGS. 1 and 2, a heating and/or intermediate annealing temperature, $T_z$, is shown in °C. along the ordinate of the respective graphs and the amount of final deformation or work done on a tape is shown in % amount of the tape's thickness before the final deformation or work along the abscissa thereof. In polycrystalline Ni-Fe alloys having maximum nickel content of 53 wt. % or less, a crystalline texture can be created in which the crystals lie parallel to the rolling plane with their cube plane and lie parallel and perpendicular to the rolling direction with their cube edges. Since the cube edge is a direction of easy magnetization, the cube texture (001) <001> thereof has longitudinal and transverse magnetic privileged directions. Such crystalline texture is preferably attained after a substantial amount of cold-working or deformation of a tape, on the order of about 90 to 99%, and after a final annealing within the temperature range of about 900° to 1050° C., with the pre-requirement that any heating or intermediate annealing before the final deformation occur at a temperature above about 600° C. but below the temperature limit shown by the shaded curve area 1 of FIG. 1, i.e., such intermediate annealing temperature is in the area designated "A". The sharpness of the cube texture generally improves with a greater amount of final deformation or working as well as with attainment of a finer grained initial structure before final deformation, i.e., the closer $T_z$ is to the recrystallization temperature of about 600° C. In instances one elects an intermediate annealing temperature in area "B" of FIG. 1 (i.e., above temperature limit 1), one obtains a relatively fine-grained isotropic structure. As may be appreciated, areas "A" and "B" cannot be completely and exactly delimited from one another, which is why the temperature limit 1 is illustrated by a shaded curve. The boundary between these areas may be somewhat displaced, depending upon, for example, the amount of slag particles in the alloy smelt and/or depending on the presence of certain additives, particularly small amounts of Al or Mo. Nevertheless, the basic tendencies above explained remain.

When one anneals an alloy, which exhibits a cube structure on a final annealing at a temperature in the range of 900° to 1050° C., at a temperature in the range of 1050° C. to 1200° C., a secondary recrystallization with a strong grain growth is initiated which destroys the cube state. The temperature limit or boundary for the heat area in which secondary recrystallization occurs is illustrated at FIG. 2 as shaded curve 2. Of course, curve 2 corresponds to the temperature limit 1 of FIG. 1 because the presence of a cubic structure is a precondition for secondary recrystallization. Normally, secondarily recrystallized material contains grains of varying orientation, i.e., in addition to a series of magnetically unfavorable grain positions, such material also has magnetically favorable grain positions, with an (210)-orientation parallel to the rolling plane and a <001>-orientation parallel to the rolling direction. With substantially corresponding conditions, particularly with relatively thin tapes having a thickness of 0.05 mm and less, one may, with secondary recrystallization, attain a preferred orientation of grains in the (210) <001>-positions by following the principles of the invention. Accordingly, in instances when $T_z$ is selected below the temperature limit 3 of FIG. 2, i.e., within area "C" between about 600° to 700° C., one first obtains, with a final annealing, a normal secondary recrystallization whereby the grain size increases with an increased amount of final deformation. In instances $T_z$ is selected between the temperature limits 2 and 3 of FIG. 2, i.e., within area "D", then during final annealing the preferred (210) <001> orientation is attained. This grain position or orientation is visible in a micrograph of a so-treated tape, particularly by the twinning bands which lie at an angle of about ±37° or, less often at an angle of about ±66° to the rolling direction. In instances where $T_z$ is selected within area "B" of FIG. 2, a fine-grained isotropic structure is again formed during final annealing. As with the temperature limits 1 and 2, the final annealing temperature at which secondary recrystallization begins is likewise dependent on contaminants and deoxidizing additives, such as Al, present in the smelt under consideration. The presence of Al additives particularly increases the secondary recrystallization temperature.

In instances where one selects an amount of final deformation below about 88% (not illustrated in FIGS. 1 and 2) and a $T_z$ above 600° C., then one obtains a fine-grained isotropic structure after final annealing.

With the foregoing general discussion in mind, there is now presented detailed Examples which will illustrate to those skilled in the art the manner in which the invention is carried out. However, these Examples are not to be construed as limiting the scope of the invention in any way.

In order to produce tape cores having a fine-grained isotropic structure in accordance with the principles of the invention, the following general procedures were utilized:

An as-cast alloy ingot was hot-rolled to a tape thickness of about 7 mm, then cold-rolled to a thickness of about 2.5 mm. After a two-hour intermediate annealing at 1000° C., the alloy strip was further cold-rolled to a thickness of about 0.35 mm and after an additional intermediate annealing for two hours at 700° C., was finally cold-rolled to a thickness of 0.05 mm. The amount of cold-rolling after the last intermediate annealing was 85.7%. Toroidal tape cores having an exterior diameter of 30 mm and an interior diameter of 15 mm were then produced from the so-attained tape strip, which had a width of 15 mm. These tape cores were finally annealed in a hydrogen atmosphere and were cooled-off in a furnace means. Thereafter, these cores were subjected to a tempering treatment in a magnetic cross-field, which was applied to the cores via permanent magnets such as alnico magnets. The so-attained cores were then examined and the certain data was measured for such cores and is set forth in the Table below.

With a ballistic process, the induction $B_5$ at 4 A/cm (approximately saturation induction) and the remanence $B_r$ of each core was measured; the remanence relation, $B_r/B_5$ of each core and the static induction rise $\Delta B_{stat}$ (which is equal to $B_5-B_r$) of each core were calculated from $B_5$ and $B_r$; the dependence of impulse permeability $\mu_p$ (which is important for impulse operation and is equal to $\Delta B/\Delta H \times 1/\mu o$, wherein $\Delta B$ is the rise in the induction on the change $\Delta H$ of the applied magnetic field strength) on induction rise $\Delta B$ was measured for a magnetic pulse duration of 50 $\mu$s and a pulse train of 20 ms for each core; and the hysteresis losses $P_{Fe}$ on modulations of up to 0.3T with a frequency of 10 kHz for each core was measured.

EXAMPLE 1

Figure 3:
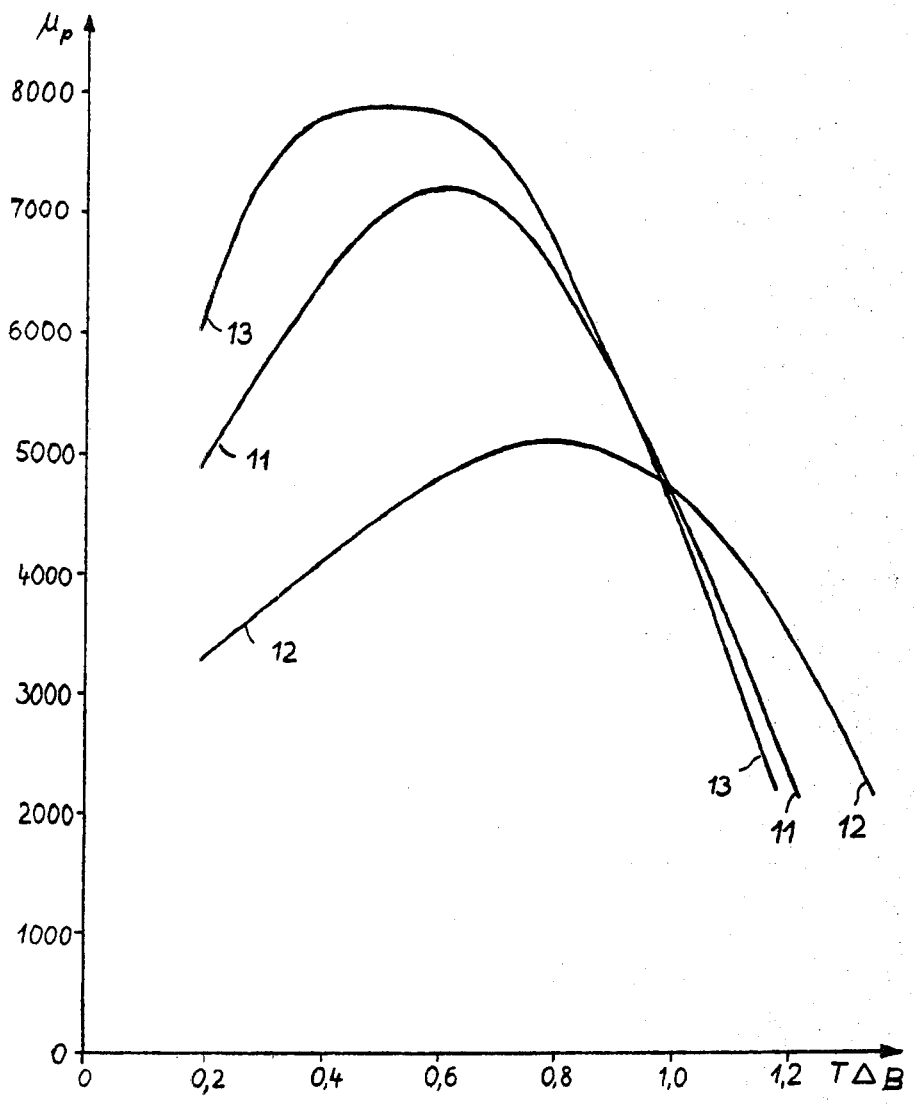
FIG. 3 is a graphical illustration of the relation between impulse permeability and induction rise in exemplary tape cores composed of varying alloys having a fine-grained isotropic structure produced in accordance with the principles of the invention.

A nickel-iron alloy having 50.40 wt. % Ni, 0.39 wt. % Mn, 0.16 wt. % Si with the remainder iron was prepared, cast into an ingot and worked up into tape cores in accordance with the procedure set forth above. Fianl annealing was at 950° C. for 4 hours. For the tempering treatment, the so-produced tape cores were heated up to 550° C. in the magnetic cross-field and then quickly cooled off in the furnace to a tempering temperature of 480° C. at a rate of about 200° C. per hour and held at this temperature for 4 hours. Thereafter, the so-tempered cores were further cooled off in the furnace. Curve 11 of FIG. 3 shows the impulse permeability, $\mu_p$, as a function of the induction rise, $\Delta B$, for these cores. Further measured data, like that of the following Examples, is set forth in the Table below.

EXAMPLE 2

An alloy ingot having an identical composition as set forth in Example 1 was worked into a substantially identical manner as set forth in Example 1 into tape cores. The treatment of these cores differed from those in Example 1 only in that a tempering temperature of 460° C. was utilized. Curve 12 of FIG. 3 illustrates the $\mu_p$ as a function of $\Delta B$ for these cores.

EXAMPLE 3

A nickel-iron alloy having 47.55 wt. % Ni, 0.43 wt. % Mn, 0.15% Si with the remainder iron was prepared, cast into ingot and worked up into toroidal tape core in accordance with the procedure set forth above. The tape cores so-produced were finally annealed at 1150° C. in hydrogen for 4 hours. After final annealing the tape cores were heated without the magnetic cross-field, in hydrogen to 550° C. Thereafter the cores were cooled to 500° C. and tempered at this temperature for 1 hour and then quickly cooled outside the furnace to freeze-in excess vacancies. Subsequently, the so-treated cores were subjected to a 4 hours magnetic crossfield tempering at 400° C. Curve 13 of FIG. 3 shows the $\mu_p$ as a function of $\Delta B$ for these cores.

As can be seen from the curves in FIG. 3 and the related data in the Table below, impulse permeabilities between 4000 and 5000 are attained with an induction rise of 1T via magnetic cross-field tempering of Ni-Fe alloys having an isotropic structure.

A further increase of impulse permeability is attained with Ni-Fe alloys having an anisotropic structure. The following Examples illustrate to those skilled in the art the manner in which these embodiments of the invention are carried out. However, these Examples are not to be construed as limiting the scope of the invention in any way.

In all of the following Examples, the as-cast alloy ingots were first hot-rolled to a thickness of about 7 mm and then cold-rolled to a thickness of 0.05 mm. In certain instances, an intermediate annealing step was inserted at a thickness of about 2.5 mm. After the final deformation, toroidal tape cores were produced from the so-attained tapes, which had a width of 15 mm. These cores had an exterior diameter of 30 mm and an interior diameter of 15 mm. The so-produced cores were finally annealed in a hydrogen atmosphere and then tempered in a magnetic cross-field in the hydrogen atmosphere. The so-attained cores were then examined and the same data was measured as with the cores having an isotropic structure and this data is set forth in the Table below.

EXAMPLE 4

Figure 4:
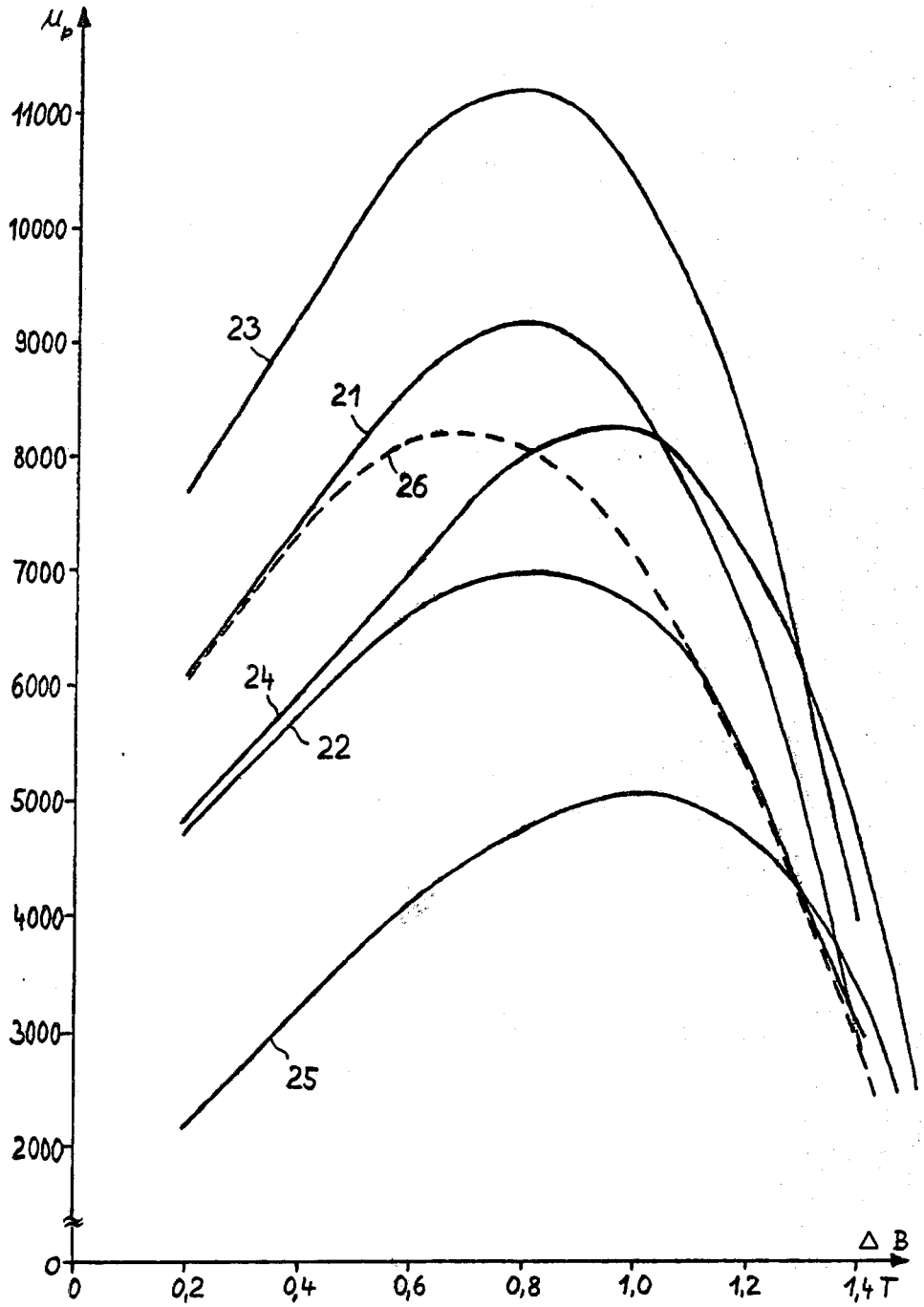
FIG. 4 is a graphical illustration of the relation between impulse permeability and induction rise in exemplary tape cores composed of varying alloys having an anisotropic structure produced in accordance with the principles of the invention.

A nickel-iron alloy having 50.40 wt. % Ni, 0.39 wt. % Mn, 0.16 wt. % Si with the remainder iron was prepared and cast into ingots. Such ingots were hot-rolled to a thickness of about 7 mm and then cold-rolled to a thickness of 0.05 mm without intermediate annealing. This amount of working corresponds to a final deformation of 99.3%. The hot-rolling before the final deformation substantially corresponds to intermediate annealing at about 650° C. After formation, the toroidal tape cores were finally annealed at 1150° C. for 5 hours and, accordingly, had a secondary recrystallization structure. In the tempering treatment, the cores were first heated up to 550° C., then cooled off in the furnace to a tempering temperature of 480° C. at a cooling rate of 200° C. per hour. After a 4 hour tempering at this temperature (i.e., 480° C.) in the magnetic cross-field, the tape cores were allowed to cool-off further in the furnace without control and were then examined. Curve 21 of FIG. 4 illustrates the $\mu_p$ as a function of $\Delta B$ for these cores, with further data set forth in the Table below.

EXAMPLE 5

A Ni-Fe alloy ingot identical in composition to that set forth in Example 4 was, after hot-rolling, first cold-rolled to a thickness of 2.5 mm and then intermediately annealed at 750° C. for 2 hours. Thereafter, the alloy strip was further cold-rolled. to a thickness of 0.05 mm, with a final deformation of 98%. After tape core formation and a 5 hour final annealing of the toroidal cores at 1150° C., a crystalline structure with a preferred (210)

<001>-position was generated. Subsequently, the cores were heated up to 550° C., then cooled in the furnace to 500° C. and then tempered for 1 hour at this temperature. Then, excess vacancies were frozen-in by quick quenching outside the furnace. Thereafter, a 4 hour tempering in the magnetic crossfield at 400° C. took place. The cores were then examined and the relevant data recorded. Curve 22 of FIG. 4 illustrates the $\mu_p$ as a function of ΔB for these cores.

EXAMPLE 6

An alloy strip having an identical composition to that set forth in Example 4 was, after hot-rolling and cold-rolling to a thickness of 2.5 mm, intermediately annealed at 950° C. for 2 hours. Subsequently, it was cold-rolled to a thickness of 0.05 mm, which corresponds to a final deformation of 98%. After tape core formation and a 5 hour final annealing at 1150° C., a structure having the preferred (210) <001>-position was generated in the tape material and which exhibited a smaller grain-size than present in the structure of Example 5. While the resultant tape cores were subjected to a magnetic cross-field tempering, the cores were allowed to cool off in the furnace from 550° C. to about 200° C., at a cooling rate of 150° C. per hour and thereafter were allowed to cool without further control. Curve 23 of FIG. 4 shows the $\mu_p$ as a function of ΔB for these cores, with the other relevant data being recorded in the Table below.

As can be seen, the cores of Example 6 have significantly increased impulse permeabilities in comparison with those of Example 5 and this improved characteristic is attributed to the smaller grain size present in the tape cores of Example 6.

EXAMPLE 7

A tape core was produced from the alloy and with the procedure set forth in Example 6 above. The only difference with respect to the Example 6 procedure, was that in this Example during the magnetic cross-field tempering, the core was controllably cooled from 550° C. to 200° C. at a cooling rate of 30° C. per hour. Curve 24 of FIG. 4 shows the $\mu_p$ as a function of ΔB for this core, while the other data is recorded in the Table below.

In comparison with the cores of Example 6, the core of Example 7 exhibited an increased impulse permeability at a high induction rise.

EXAMPLE 8

An alloy ingot having the composition set forth in Example 4 was cold-rolled to a thickness of 2.5 mm after hot-rolling and was then intermediately annealed at 950° C. for 2 hours and thereafter cold-rolled to a thickness of 0.05 mm and wound into toroidal cores as set forth above. A crystalline structure with a preferred cubic texture in the rolling direction was created within the tape material via a 4 hour final annealing at 950° C. The tempering treatment of these cores in the magnetic cross-field ensued in such a manner that the cores were first heated up to 550° C., then cooled to 430° C. with a cooling rate of 200° C. per hour and maintained at this temperature for 4 hours and then further cooled in the furnace. Curve 25 of FIG. 4 shows the $\mu_p$ as a function of ΔB for these cores.

EXAMPLE 9

A nickel-iron alloy having 47.55 wt. % Ni, 0.43 wt. % Mn, 0.15 wt. % Si and the remainder iron was prepared and cast into ingots. After hot-rolling, the alloy strips were first cold-rolled to a thickness of 2.5 mm, then intermediately annealed at 750° C. for 2 hours and finally cold-rolled to a thickness of 0.05 mm and formed into cores. A crystalline structure with the preferred (210) <001>-position was created within such tape material by a 5 hour annealing of these cores at 1150° C. After the final annealing, the cores were heated up to 550° C., then cooled to 500° C., tempered for 1 hour at this temperature and subsequently quenched outside the furnace in order to freeze-in the excess vacancies. Thereafter a 4 hour magnetic cross-field tempering at 400° C. was undertaken. Curve 26 of FIG. 4 shows the $\mu_p$ as a function of ΔB for these cores.

In the following Table, a series of $\mu_p$ values at varying induction rises ranging from 1.0 to 1.4T, as well as the earlier mentioned values are compiled in numerical order for the average values recorded from the cores of each of the above Examples. The Table also shows the Curie temperature $T_c$, the remanence relation $B_r/B_5$ and the static induction rise, $\Delta B_{stat}$.

As can be seen from the Table below, tape cores produced in accordance with the principles of the invention exhibit impulse permeabilities above 10,000 with an induction rise of 1T and still exhibit impulse permeabilities of 4,700 with an induction rise of 1.4T. The hysteresis losses for these tape cores at 0.3T and 10 kHz are, however, higher than in tape cores composed of known alloys having 61 to 67 wt. % Ni, 2 to 4 wt. % Mo, with the remainder iron, which typically exhibit a hysteresis loss of about 14 W/kg after a magnetic cross-field tempering. However, the tape cores produced in accordance with the principles of the invention are eminently suitable for technical applications. Further, the hysteresis loops of toroidal tape cores produced from the aforesaid Ni-Fe-Mo alloy are relatively flat whereas the hysteresis loops of tape cores produced in accordance with the principles of the invention are somewhat steeper. Particularly the tape cores produced in accordance with the principles of the invention so as to have an anisotropic structure exhibit hysteresis loops which are constricted in the middle thereof, somewhat similar to a Perminvar loop, so that the remanence and coercivity thereof are relatively small.

TABLE

| Example | $T_c$ (°C.) | $B_5$ (T) | $B_r/B_5$ | $\Delta B_{stat}$ (T) | $\mu_p$ for ΔB = 1.0 T | 1.2 T | 1.3 T | 1.4 T | $P_{Fe}$ (W/kg) |
|---|---|---|---|---|---|---|---|---|---|
| 1 | 470 | 1.5 | 0.17 | 1.26 | 4700 | 2300 | — | — | 28.5 |
| 2 | 470 | 1.5 | 0.08 | 1.39 | 4700 | 3500 | 2700 | — | 33.0 |
| 3 | 450 | 1.5 | 0.17 | 1.21 | 4500 | 2000 | — | — | 29.0 |
| 4 | 470 | 1.5 | 0.05 | 1.41 | 8300 | 6400 | 4800 | 2900 | 22.6 |
| 5 | 470 | 1.5 | 0.03 | 1.43 | 6700 | 5300 | 4200 | 3100 | 25.6 |
| 6 | 470 | 1.5 | 0.03 | 1.44 | 10400 | 8100 | 6000 | 4000 | 21.8 |
| 7 | 470 | 1.5 | 0.01 | 1.46 | 8200 | 7100 | 6100 | 4700 | 21.8 |
| 8 | 470 | 1.5 | 0.05 | 1.41 | 5000 | 4700 | 4100 | 3400 | 33.8 |

TABLE-continued

| Example | $T_c$ (°C.) | $B_5$ (T) | $B_r/B_5$ | $\Delta B_{stat}$ (T) | $\mu_p$ for $\Delta B$ = 1.0 T | 1.2 T | 1.3 T | 1.4 T | $P_{Fe}$ (W/kg) |
|---|---|---|---|---|---|---|---|---|---|
| 9 | 450 | 1.5 | 0.06 | 1.39 | 7000 | 5200 | 4000 | 2700 | 22.8 |

Figure 5:
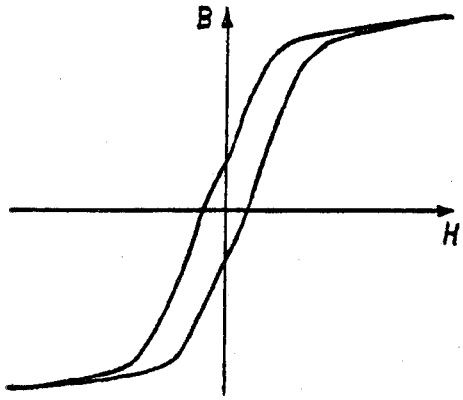
FIGS. 5–7 are graphical illustrations of the relation between dynamic hysteresis loops at a frequency of 50 Hz for tape cores of varying structure produced in accordance with the principles of the invention.
Figure 6:
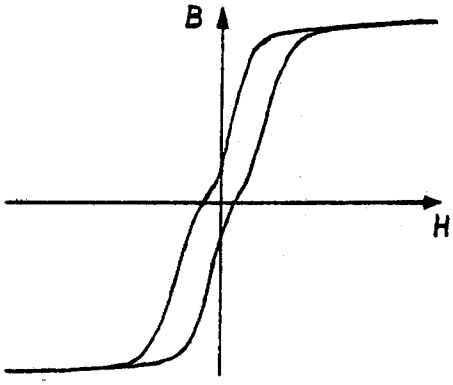
Figure 7:
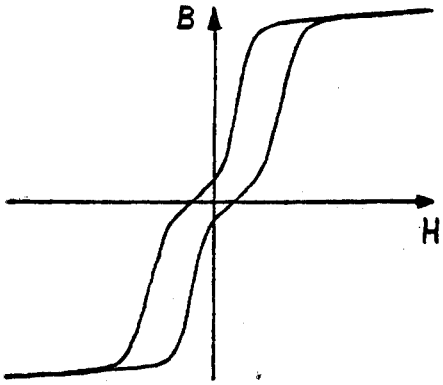

FIG. 5 shows the hysteresis loop of an exemplary core having an isotropic structure produced in accordance with Example 2 above. FIG. 6 illustrates the hysteresis loop of an exemplary core having the preferred (210) <001>-position produced in accordance with Example 7 above and FIG. 7 shows the hysteresis loop of an exemplary core having a predominantly cubic texture, thus a preferred (100) <001>-position, produced in accordance with Example 8 above. All of these hysteresis loops were dynamically measured at 50 Hz in a magnetic field in the circumferential direction of the respective tape cores, thus in the rolling direction of such cores.

In FIGS. 6 and 7, the effect of the superposition of the magnetic field-induced privileged direction perpendicular to the measuring direction as well as the crystallographic texture with the privileged direction in the measuring direction can be clearly seen by the constriction of these hysteresis loops. With relatively low modulation, magnetic reversal is essentially determined by a rotary process against the uniaxial anisotropy, $K_u$, whereas at higher modulations, predominantly Bloch wall displacements apparently occur. The form of a hysteresis loop depends on the sharpness of the crystallographic privileged direction in the measuring direction, on the coercive field strength of the material and on the impressed magnetic privileged direction perpendicular to the measuring direction.

In tape cores produced in accordance with Example 8, as shown at FIG. 7, a relatively strong cross-privileged direction has been impressed in superposition of the preferred cubic texture in the rolling direction via the 4 hour magnetic cross-field tempering at 430° C. In contrast to this, tape cores produced in accordance with Example 7 exhibit a somewhat lower coercive field strength, as shown at FIG. 6. The hysteresis loop of the Example 7 cores is more strongly rounded than that shown at FIG. 7 because the (210) <001>-texture has a poorer definition than the cube texture. Further, the constriction of the hysteresis loops for the Example 7 cores is lower, which indicates that the $K_u$ thereof (uniaxial anisotropy) was only relatively weakly impressed during the magnetic cross-field tempering. The impulse permeability with an induction rise of 1.2T for the cores illustrated at FIG. 6 was 7,100 and is thus the highest of the three exemplary cores whose hysteresis loops are illustrated. As can be seen from the Examples, in order to achieve a particularly high impulse permeability with high induction rise, it is important that both the texture formation in the measuring direction as well as the uniaxial anisotropy perpendicular to the measuring direction be suitably adjusted with regard to one another within a tape material.

Tape cores produced in accordance with the principles of the invention have numerous uses in a multitude of component elements which require high impulse permeability given a high induction rise but not a constancy of impulse permeability as a function of induction rise. Tape cores produced in accordance with the principles of the invention are particularly suitable for pulse transformers, such as, for example, thyristor firing transformers or modulation transmitters for switching power supply units as well as for thyristor choke coils having unipolar operation. Further, because of their relatively low loss characteristics, tape cores of the invention are also useful, for example, for thyristor choke coils with bipolar operation.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. In a process for producing tape cores composed of a Ni-Fe alloy having 45 to 53 weight percent nickel with the remainder iron and including relatively small amounts of deoxidizing and processing additives whereby an ingot composed of said alloy is worked into a tape having a thickness of about 0.01 to 0.1 mm and wound into a tape core, which tape core is then subjected to at least a one hour final annealing at a temperature of at least about 900° C. and the so-annealed tape core is then subjected to a tempering treatment in a magnetic field in which the lines of force are applied in the tape plane perpendicular to the rolling direction of the tape, the improvement comprising wherein:

(1) before winding said tape core, (a) said tape is heated to a temperature between approximately 600° and 700° C. and (b) subjecting the so-heated tape to a final deformation of at least 90 percent of said tape's thickness before said final deformation; and (2) after winding said tape into a tape core, subjecting said core to a final annealing at a temperature ranging between about 1050° and 1200° C. so as to produce a secondary recrystallization structure within said tape.

2. In a process for producing tape cores composed of a Ni-Fe alloy having 45 to 53 weight percent nickel with the remainder iron and including relatively small amounts of deoxidizing and processing additives whereby an ingot composed of said alloy is worked into a tape having a thickness of about 0.01 to 0.1 mm and wound into a tape core, which tape core is then subjected to at least a one hour final annealing at a temperature of at least about 900° C. and the so-annealed tape core is then subjected to a tempering treatment in a magnetic field in which the lines of force are applied in the tape plane perpendicular to the rolling direction of the tape, the improvement comprising:

heating and finally deforming said tape before winding said tape into said tape core and after winding the so-processed tape into a core, subject said core to a final annealing;

said heating occurring up to a temperature of at least about 700° C. and below a temperature limit which increases with an increasing amount of final deformation, said temperature limit being such that above said limit a structure is formed in said tape from which a relatively fine-grained isotropic structure arises during final annealing, said final deformation amounting to at least 90 percent of said tape's thickness before said final deformation; and said final annealing occurring at a temperature ranging between about 1050° and 1200° C. so that an anisotropic structure with a privileged (210) <001> direction in the rolling direction of the tape is produced.

3. A process as defined in claims 1 or 2 wherein said alloy contains 47 to 52 weight percent nickel.

4. A process as defined in claims 1 or 2 wherein said alloy contains 49 to 51 weight percent nickel.

5. A process as defined in claims 1 or 2 wherein said tempering treatment in said magnetic field includes maintaining said tape cores at a temperature in the range between about 300° C. and the Curie temperature of said tape material for at least about 30 minutes.

6. A process as defined in claim 2 wherein a structure is formed in said tape which has at least 20% of crystallites therein aligned in said privileged direction.

7. A Ni-Fe magnetic tape core comprised of 45 to 53 weight percent nickel with the remainder iron and including relatively small amounts of deoxidizing and processing additives, characterized by a secondary recrystallization structure therein and a relatively high impulse permeability of about 8300 with an induction rise of 1.0T, about 6400 with an induction rise of 1.2T, about 4800 with an induction rise of 1.3T and about 2900 with an induction rise of 1.4T.

8. A Ni-Fe magnetic tape core comprised of 45 to 53 weight percent nickel with the remainder iron and including relatively small amounts of deoxidizing and processing additives, characterized by a structure therein having a privileged (210) <001> direction in the rolling direction of the tape and a relatively high impulse permeability ranging between about 6700 to 10,400 with an induction rise of 1.0T, ranging between about 5300 to 8100 with an induction rise of 1.2T, ranging between about 4200 to 6100 with an induction rise of 1.3T and ranging between about 3100 to 4000 with an induction rise of 1.4T.

* * * * *